US007155759B2

(12) United States Patent
Milne

(10) Patent No.: US 7,155,759 B2
(45) Date of Patent: Jan. 2, 2007

(54) LIQUID DELIVERY SYSTEM FOR A SINK

(76) Inventor: Victoria Milne, 350 Third Ave., #123, New York, NY (US) 10010

( * ) Notice: Subject to any disclaimer, the term of this patent is extended or adjusted under 35 U.S.C. 154(b) by 107 days.

(21) Appl. No.: 10/820,192

(22) Filed: Apr. 7, 2004

(65) Prior Publication Data

US 2004/0194208 A1 Oct. 7, 2004

Related U.S. Application Data

(60) Provisional application No. 60/460,865, filed on Apr. 7, 2003.

(51) Int. Cl.

| | |
|---|---|
| ***E03C 1/04*** | (2006.01) |
| ***E03C 1/02*** | (2006.01) |
| ***E03C 1/16*** | (2006.01) |
| ***A47K 1/04*** | (2006.01) |

(52) U.S. Cl. ..... 4/675; 4/619; 4/624

(58) Field of Classification Search ..... 4/300.3, 4/619, 653, 675, 624
See application file for complete search history.

(56) References Cited

U.S. PATENT DOCUMENTS

| | | | | | |
|---|---|---|---|---|---|
| 624,176 | A | * | 5/1899 | Chisholm | 4/653 |
| 1,178,817 | A | * | 4/1916 | Murton | 134/199 |
| 1,426,046 | A | * | 8/1922 | Cohen | 4/653 |
| 1,805,560 | A | * | 5/1931 | Barta | 4/651 |
| 4,231,123 | A | * | 11/1980 | Cheng | 4/651 |

* cited by examiner

*Primary Examiner*—Charles E. Phillips
(74) *Attorney, Agent, or Firm*—Gottlieb, Rackman, Reisman, P.C.

(57) ABSTRACT

A liquid delivery system for a sink comprises a basin having a plurality of perforations located therein in an irregular pattern, and a faucet assembly in fluid communication with said a source of liquid and with said perforations. Upon selective activation of said faucet assembly, the liquid is introduced into the interior of the basin from all sides in a plurality of independent streams that converge toward and intersect with one another in the air above the basin to form a pleasing, dome-shaped display.

17 Claims, 4 Drawing Sheets

LIQUID DELIVERY SYSTEM FOR A SINK

REFERENCE TO RELATED APPLICATIONS

This application claims the benefit of prior co-pending U.S. Provisional Patent Application Ser. No. 60/460,865, filed Apr. 7, 2003.

TECHNICAL FIELD

The present invention relates broadly to the field of plumbing fixtures, and in particular, to a novel liquid delivery system for a sink that is adapted primarily for use in a residential household setting or in a commercial hospitality setting. More specifically, this invention relates to a sink that provides a novel configuration for the delivery of water or other liquids which results in a pleasing, fountain-like display when the faucet mechanism is actuated.

BACKGROUND OF THE INVENTION

Since the advent of indoor plumbing for dwelling structures such as homes and hotels, efforts have been made to create plumbing fixtures such as sinks for bathrooms, lavatories and other environments which are practical yet esthetically pleasing, not only in their appearance but also in their operation. Traditionally, such sinks have molded from cast iron or have been manufactured from stamped sheet metal in a substantially hemispherical shape, and a durable surface coating, such as porcelain enamel, has usually been applied to the exposed inside surface of the sink bowl, and sometimes also to its outside surface, although nowadays such sinks may be formed of other substrate materials (e.g., plumbing brass), and may be coated with other coating materials (e.g., polished nickel), as well.

However, despite many years of the design, as well as the manufacture and production, of countless manifestations of sinks and lavatory washbasins and their associated faucet mechanisms, the manner in which the water is introduced and delivered into the sink bowl upon actuation of the faucet mechanism has not changed significantly. Typically, the water is drawn (or pumped) through one or more pipe conduits from a remote water source (such as a private well or a public utility's water supply reservoir) into a faucet assembly, and is conventionally then discharged from the faucet assembly into the sink bowl, either in two separate downward streams from two independent spouts (one for hot water and the other for cold), or in more recent manifestations, in a unitary downward stream from a single spout (with the hot and cold water having been pre-mixed within the faucet assembly); the rate of the water flow is typically controlled by two user-operated flow control mechanisms (one for the hot water and one for the cold), or again in more recent manifestations, by a single user-operated flow control mechanism associated with and located within the faucet assembly, which simultaneously functions to allow the user to adjust the proportions of hot and cold water so as to achieve a mixture having the desired water temperature.

Although the practical advantages of these prior art liquid delivery systems cannot be overlooked, they nevertheless lack creativity and imagination in the way in which the water is dispensed and is introduced into the sink bowl. In view of these deficiencies of the prior art, it is the principal object of this invention to provide a novel liquid delivery system for sinks, lavatory washbasins and the like that achieves the same practical results as the prior art systems, yet provides for the water to be delivered in a more esthetically pleasing manner which at the same time may also provide other wash-experience benefits.

SUMMARY OF THE INVENTION

The invention provides a liquid delivery system for sinks, lavatory washbasins and the like wherein the water is not delivered in a conventional downward stream from the tap, i.e., from one or two relatively large spouts, but is instead delivered through a plurality of small perforations that are provided in the wall of the sink bowl. In accordance with the preferred embodiment, the perforations are provided in a band that extends around the entire circumference of the sink bowl, but extends downwardly from the upper edge of the sink bowl only to a point that is just above the level of the overflow aperture of the sink bowl, as will hereinafter be described; most preferably, the perforations vary in size, and are spaced apart from one another in an irregular, random fashion. Upon actuation of the faucet mechanism, the water enters the sink bowl in a plurality of narrow streams from all sides, providing a novel and esthetically pleasing three-dimensional display of water upon its delivery into the bowl. In addition, the introduction of water from all sides in this manner provides a water delivery mode that may also improve the quality of the cleansing resulting from its use.

BRIEF DESCRIPTION OF THE DRAWINGS

These and other aspects, features, objects and advantages of the present invention will become more apparent from the following detailed description of the presently most preferred embodiment thereof (which is given for the purposes of disclosure), when read in conjunction with the accompanying drawings (which form a part of the specification, but which are not to be considered limiting in its scope), wherein.

DETAILED DESCRIPTION OF THE PREFERRED EMBODIMENT

Figure 1:
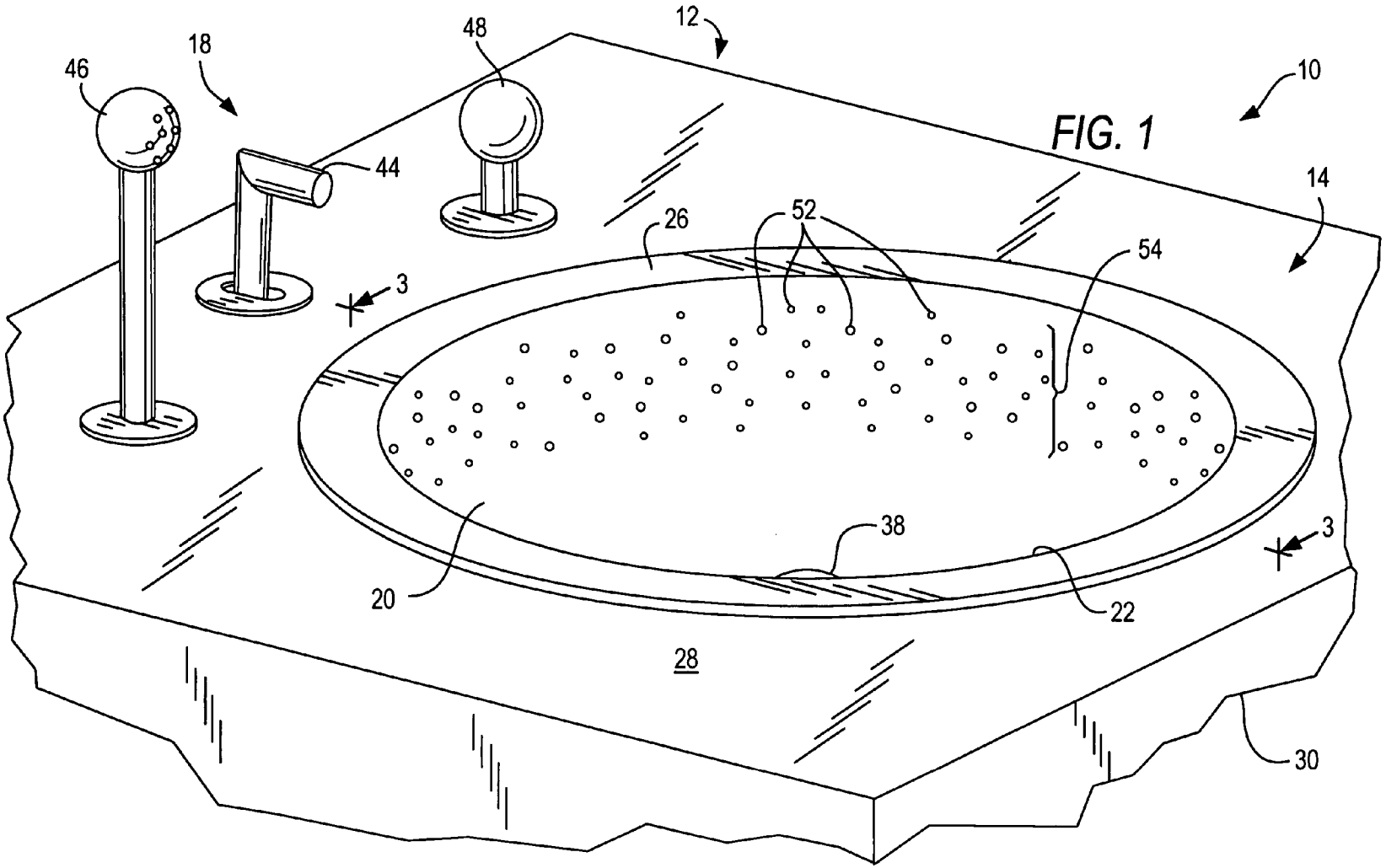
FIG. 1 is a perspective view of the preferred embodiment of the liquid delivery system of the present invention, illustrating its structure and appearance in the absence of the flow of water.

The preferred embodiment of the present invention will now be further described with reference to the accompanying drawings, wherein like reference numerals designate like or corresponding parts throughout the several views. Although the invention will be illustratively described hereinafter with reference to a lavatory washbasin, it should be understood that the invention is not limited to the environment of a bathroom or lavatory, but could be used in other similar plumbing environments, e.g., in a kitchen sink or work sink. Moreover, although the liquid to be delivered will commonly be conventional lavatory water, it is to be understood that other liquids may be used in place of water, and accordingly, all references hereinbelow to water shall be understood as referring not only to lavatory water itself, but to any other appropriate liquid as well.

Referring to the drawings, a liquid delivery system for a lavatory washbasin in accordance with the preferred embodiment of the present invention is generally designated 10. Liquid delivery system 10 includes a conventional sink assembly 12, which principally comprises a sink bowl 14, a drain assembly 16, and a faucet assembly 18. Sink bowl 14 comprises a concave cavity or basin 20, having an inner basin surface 22 and an outer basin surface 24. Sink bowl 14 may also include a peripheral extending flange 26, which conventionally may be sealed flush against a countertop 28 of a typical decorative vanity 30 (the latter shown only in cutaway in FIGS. 1 and 2), but the present invention is not dependent on a flush installation, and it is to be understood that the invention may be used in other environments, e.g., if the sink were installed above the countertop, or even in a free-standing environment.

Preferably, basin 20 is formed of a plumbing brass substrate coated with polished nickel, although as is well known in the art, alternative substrate materials include any material that is waterproof or that can be made waterproof, such as stainless steel or other metals (e.g., iron), plastics or other polymeric materials, ceramics, resins, rubbers, or even glass or wood, and alternative coating materials include the traditional vitreous porcelain enamel. Typically, basin 20 may be formed either by die-stamping it from a sheet of the substrate material, or by injection molding. Commonly, basin 20 is hemispherically curved, most commonly on a radius of 8.5 inches. However, basin 20 may alternatively be formed using other radii of curvature or even in other concave shapes, e.g., as a fluted, cylindrical, or pyramid-shaped cavity, or even as a non-geometric, randomly-shaped cavity.

Drain assembly 16 comprises a principal drain aperture 32 (not shown in FIGS. 1 and 2), which is located in a local depression 34, and which is in fluid communication with a waste conduit 36. Drain assembly 16 further comprises a stopper 38 for mechanically blocking principal drain aperture 32 in order to selectively retain waste water in basin 20. Stopper 38 reciprocates between a closed position (shown in FIG. 3), in which waste water will be retained, and an open position (shown in FIG. 4) in which waste water may flow freely into waste conduit 36. Drain assembly 16 also comprises an overflow duct 40 which is in fluid communication with waste conduit 36 and also with one or more overflow apertures or ports 42 (not shown in FIGS. 1 and 2), the latter being positioned not only to facilitate water drainage once basin 20 has been filled to a predetermined level, but also to compel such drainage in the event that stopper 38 remains seated within drain aperture 32 once the water retained in basin 20 has reached or exceeded that level.

Faucet assembly 18 may be of the hot/cold mixing type, and would include the usual manifold structure (not shown), having conventional on-off valves (not shown) mounted in its opposite ends, with those valves being connectable by means of threaded tubular pipes (not shown) to conduits (not shown) connected to separate sources of hot and cold water. Water admitted to the manifold structure by the on-off valves is conducted to a centrally located mixing chamber portion of the manifold, and in the preferred embodiment of the present invention, when the water exits the mixing chamber it is conducted into a water distribution conduit, which will be described in further detail hereinbelow. As is customary in mixing faucets of this type, the manifold structure is concealed within decorative vanity 30, and is connected through one or more suitable apertures therein to a conventional water flow control 44 which is also preferably coupled to the on-off valves in a typical manner, allowing selective activation thereof and consequent mixing of hot and cold water so as to achieve the desired water temperature. Although as shown illustratively in the drawings, water flow and hot/cold mixing control 44 may be located adjacent to sink bowl 14, it is to be understood that in accordance with the invention all of faucet assembly 18, including water flow and hot/cold mixing control 44, may alternatively be placed in a location that is more remote from sink bowl 14. It should also be understood that faucet assembly 18 need not even be of the mixing type, especially if liquid delivery system 10 will not be used in a traditional lavatory setting, in which case faucet assembly 18, including water flow control 44, may even be placed in a location that is remote from sink assembly 12, e.g., in a separate room or even in a separate building.

Figure 2:
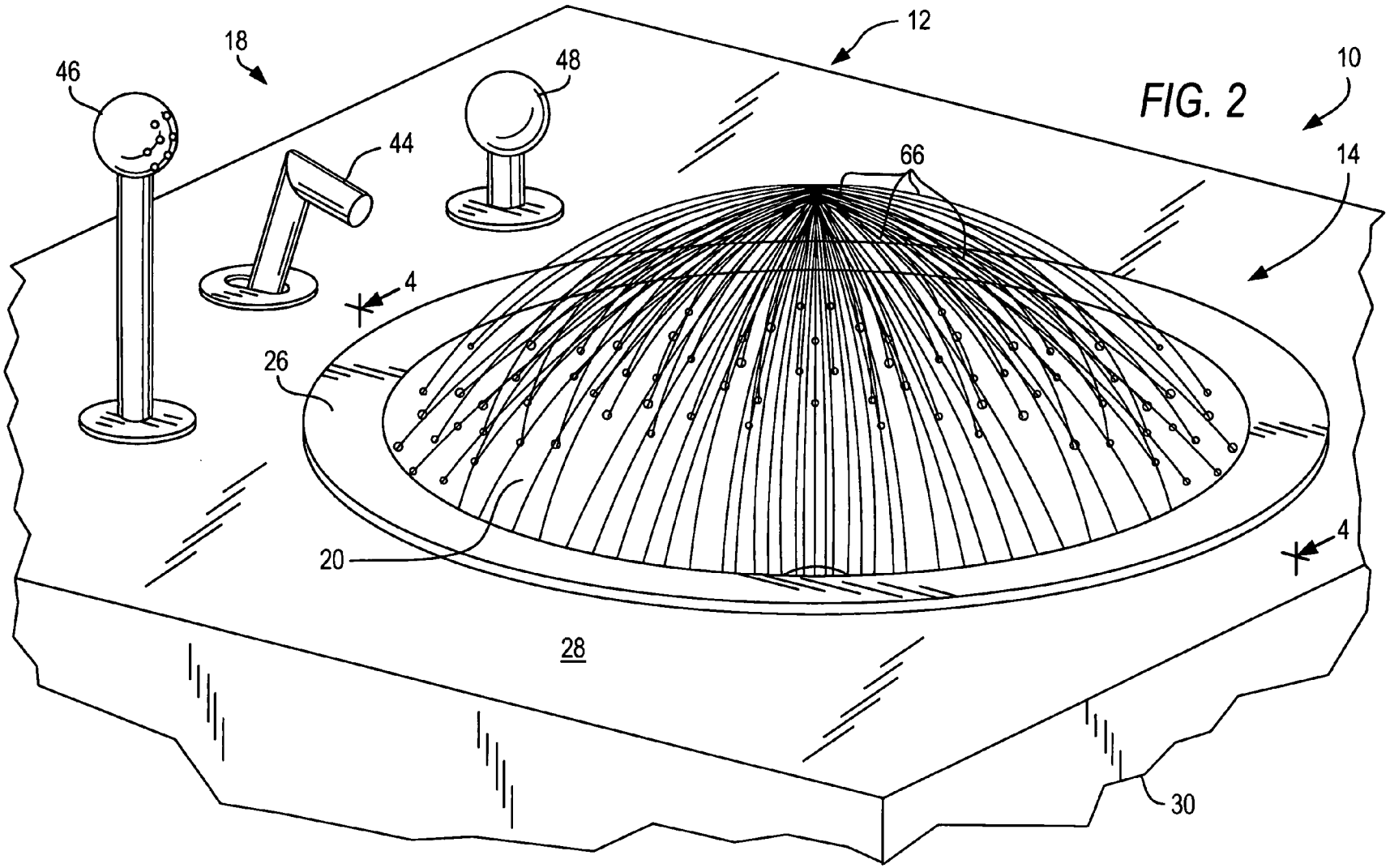
FIG. 2 is a perspective view similar to that of FIG. 1, but illustrating the manner in which water is delivered into the sink basin upon actuation of the faucet mechanism.

Preferably, however, when used in a lavatory environment sink assembly 12 further comprises a spray nozzle 46, which is adapted to provide a high velocity spray, and which may be located in a typical manner in the vicinity of the unitary water flow and hot/cold mix control 44, as shown in FIGS. 1 and 2. Spray nozzle 46 is typically connected to the manifold structure of faucet assembly 18 via a flexible hose (not shown), and also includes its own separate actuator and flow control (not shown). Sink assembly 12 also preferably comprises a waste water retention control 48, which is connected to stopper 38 and operates to effectuate its reciprocation between the open and closed positions, typically by way of a conventional pop-up linkage 50, a portion of which is visible in FIGS. 3 and 4, situated within waste conduit 36 in a conventional fashion. As shown in FIGS. 1 and 2, waste water retention control 48 also may be located in a typical manner in the vicinity of the unitary water flow and hot/cold mix control 44.

In accordance with the invention, sink bowl 14 is also provided with a plurality of perforations 52, each of which is substantially cylindrical in shape (i.e., substantially circular in cross-section) and extends entirely through basin 20, from inner surface 22 to outer surface 24. As shown best in FIGS. 1 and 3, in the preferred embodiment a single "ring" or "collar" of perforations 52 is provided, situated around the upper portion of basin 20, i.e., the perforations 52 are distributed only over a collar area 54 defined as the portion of basin 20 that is below the level of flange 26 and above the level of overflow port 42. Within that collar area 54, the perforations 52 are preferably distributed in an irregular pattern that generally resembles the stars in the celestial heavens, although it is to be understood that perforations 52 will still be distributed substantially evenly over the surface area of collar area 54. In the preferred embodiment of the present invention, with a basin hemispherically curved on a radius of 8.5 inches, the basin 20 will preferably be provided with between about one hundred and about one hundred fifty perforations 52.

In other embodiments of the present invention, however, the perforations 52 may be provided both above and below the level of overflow port 42, i.e., they may be provided over the entirety of basin 20, again distributed in an irregular pattern that generally resembles the stars in the celestial heavens, most preferably in the configuration of a specific celestial constellation, e.g., the constellation Virgo, albeit again with the understanding that perforations 52 will still be distributed substantially evenly over the surface area of basin 20. In the alternative, perforations 52 may be distributed over the surface area of basin 20 in a more regular pattern, e.g., a geometric pattern extending from the center of basin 20, such as a series of bands or rings, or alternatively in a pattern resembling a star, or a letter of the alphabet, or virtually any other pattern that can be depicted with perforations. As will be apparent to those skilled in the art, the number of perforations with which the basin 20 will be provided in these alternate embodiments of the present invention will vary depending upon the pattern chosen. Furthermore, it will also be apparent to those skilled in the art that the number of perforations with which the alternative basin shapes mentioned hereinabove can be provided will also vary, depending upon the shape and size chosen for the basin.

All of the perforations 52 may be of substantially the same diameter, with that diameter preferably being no less than 1/64 inches and no greater than 1/4 inches. More preferably, however, basin 20 is provided with perforations of at least two different discrete diameters, and most preferably, some of the perforations will have a first, larger diameter, while the remainder of the perforations will have a second, smaller diameter. It is to be understood that approximately equal numbers of perforations of each diameter will be provided, and that in their placement perforations of the larger diameter will preferably be intermixed in a random fashion with perforations of the smaller diameter. For most lavatory environments, an exemplary absolute dimension for the larger diameter is approximately 5/32 inches, while an exemplary absolute dimension for the smaller diameter is approximately 3/32 inches. Regardless of their diameter, however, it is to be understood that perforations 52 are preferably to be oriented in such a manner that liquid passing through them will be directed to converge towards a single location, as hereinafter described.

Perforations 52 may be created in any manner that is known in the art. For example, if basin 20 is to be manufactured by casting it in a mold, then the perforations may be formed within the mold itself, in any appropriate manner. Alternatively, if basin 20 is to be manufactured by a die-stamping process, then perforations 52 may be created during that process. Perforations 52 could also be created by drilling each one individually after basin 20 is already manufactured, although this method might be too labor-intensive to be economical.

It is to be understood that in those embodiments in which perforations 52 are provided over the entirety of basin 20, it is within the scope of the invention for some of those perforations to supplant either overflow port 42 or drain aperture 32, or both, and to serve as channels for the egress of waste water from basin 20, rather than to serve as channels for the ingress of fresh water into basin 20. For example, the perforations 52 located in the collar area 54 of basin 20 may provide for the introduction of water as described hereinabove, while a second "ring" of perforations 52 located below collar area 54 may provide the same function as overflow port 42, while the remainder of perforations 52, all of which are located below the second ring, may provide the same function as drain aperture 32. In such embodiments, it is to be understood that all of the perforations, when taken together, could still be distributed either in a regular pattern or in an irregular pattern that generally resembles the stars in the celestial heavens, with no apparent distinction or transition (when the faucet is not activated) between those providing ingress of fresh water and those providing for egress of waste water, or between those providing for principal (or "stoppered") egress of waste water and those providing for overflow (i.e., non-stoppered) egress of waste water.

Figure 3:
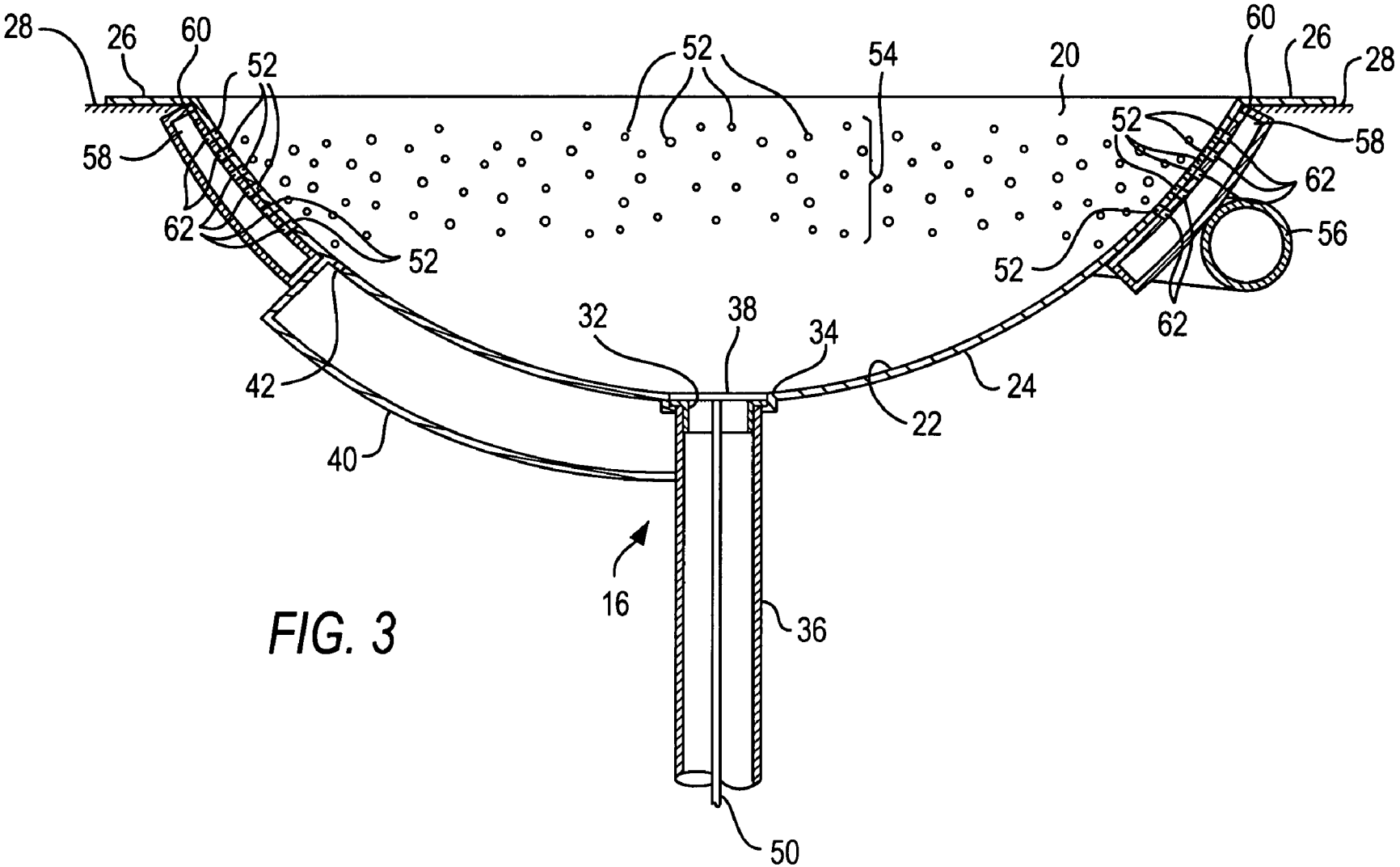
FIG. 3 is a cross-sectional view take substantially along the lines 3—3 of FIG. 1.
Figure 4:
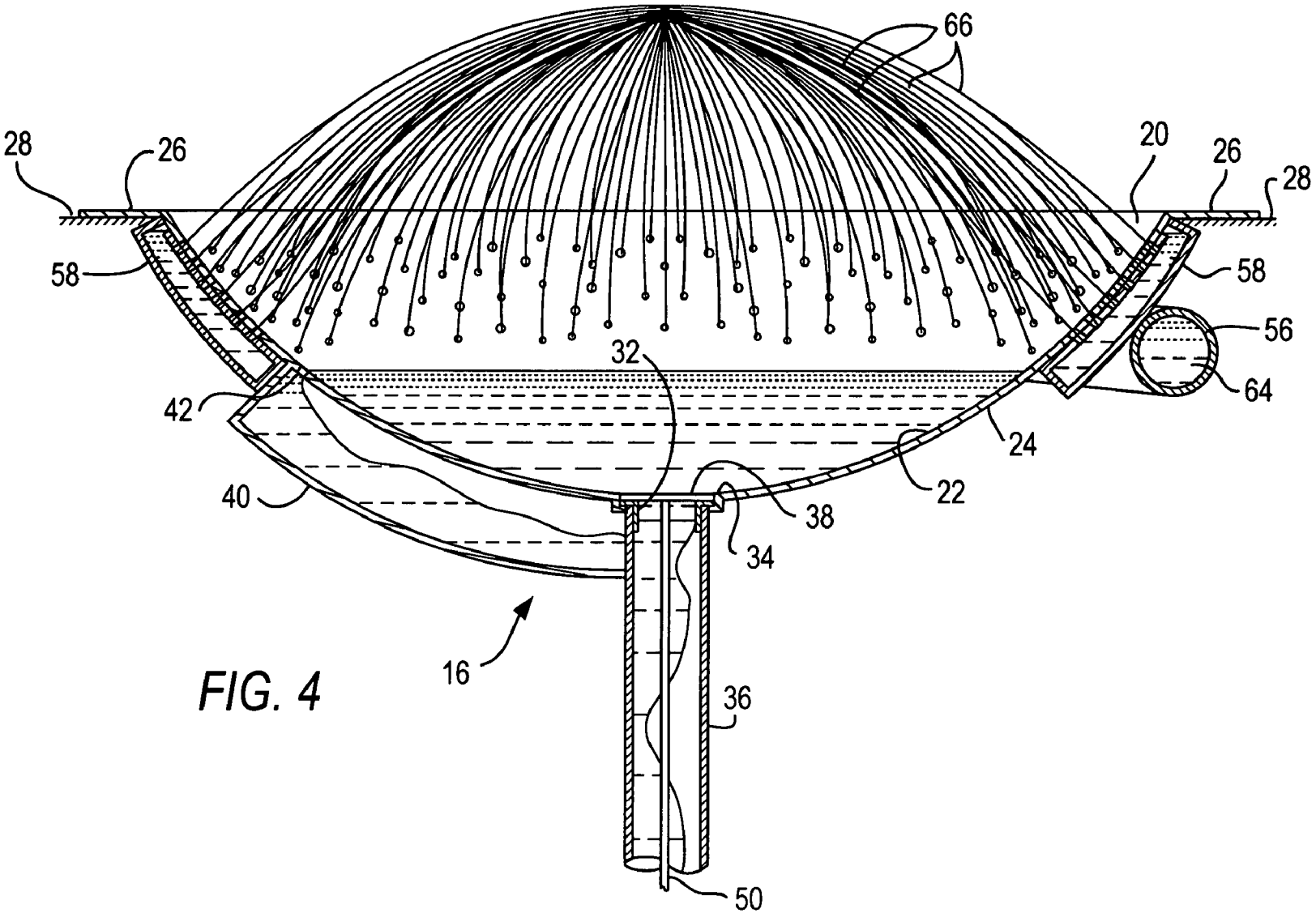
FIG. 4 is a cross-sectional view take substantially along the lines 4—4 of FIG. 2.

In accordance with the preferred embodiment of the invention, sink assembly 12 also includes a liquid distribution conduit 56 which is in fluid communication with the perforations 52 in basin 20. As shown in FIGS. 3 and 4, conduit 56 is preferably circular in cross-section, and communicates with the perforations 52 in collar area 54 of basin 20 through an annular liquid dispersion chamber 58 and an annular thickening element 60. Dispersion chamber 58 and thickening element 60 are secured to basin 20 in any conventional manner, with thickening element 60 juxtaposed between dispersion chamber 58 and outer basin surface 24, although it is possible to pre-form basin 20 and thickening element 60 integrally, in the course of an injection molding manufacturing process. In any event, thickening element 60 is provided with a plurality of perforations 62, the number and placement of which substantially corresponds to the number and placement of perforations 52 in the collar area 54 of basin 20, and thickening element 60 is secured to outer basin surface 24 such that perforations 62 are substantially aligned with perforations 52, thereby permitting fluid communication therethrough from dispersion chamber 58 to the interior of basin 20.

The operation of liquid delivery system 10 will now be described. When faucet assembly 18 is actuated (i.e., when water flow control 44 is moved from the position shown in FIG. 1 towards the position shown in FIG. 2), water 64 flows into conduit 56. Thereafter, as shown best in FIG. 4, the water flows from conduit 56 through one or more apertures (not shown) into dispersion chamber 58. After filling the void in dispersion chamber 58, the water is ejected through perforations 62 in thickening element 60, and then into basin 20 through perforations 52 in collar area 54, forming a multiplicity of independent narrow irregularly spaced streams 66 which enter basin 20 from all sides. The inclusion of thickening element 60 with perforations 62, and the alignment of perforations 62 with perforations 52, form short channels which direct the water steams 66 and preferably insure that the streams are sufficiently elongated so as to converge towards and intersect with one another in the air above the sink bowl 14, thereby forming a pleasing, dome-shaped liquid display, as shown best in FIG. 2. It is to be understood, however, that a dome-shaped display, while preferable, is not essential to the invention.

While there has been described what are at present considered to be the preferred embodiments of the present invention, it will be apparent to those skilled in the art that the embodiments described herein are by way of illustration and not of limitation. For example, there may be other ways in which to direct the water streams 66 in order to achieve the desired effect, such as by providing individual nozzles or water jets, rather than by providing a thickening element 60 with its perforations 62 that are aligned with perforations 52 in basin 20. However, this alternative is not preferred, since it would substantially change the appearance and texture of the inner surface 22 of basin 20, and the effect of the water streams produced might not be as pleasing. Nevertheless, it is to be understood that various changes and modifications may be made in the embodiments disclosed herein without departing from the true spirit and scope of the present invention, as set forth in the appended claims.

The invention claimed is:

1. An apparatus for delivering a liquid into a sink, said apparatus comprising a sink with a cavity having an inner wall and an outer wall and having a plurality of perforations extending therethrough, said perforations being distributed over a collar portion of said cavity and being in fluid communication with a source of said liquid, said apparatus further comprising a distribution conduit positioned outside said cavity adjacent said outer wall and substantially surrounding said collar portion, said conduit being in fluid communication with said source of said liquid, a dispersion chamber juxtaposed between said conduit and said outer wall, said chamber being in fluid communication with said conduit, and a thickening element abutting said outer wall and juxtaposed between said chamber and said outer wall, said thickening element having a plurality of apertures extending therethrough, said plurality of apertures being in fluid communication with said chamber, and each one of said plurality of apertures being in fluid communication with one of said plurality of perforations, and said apparatus being selectively operable to introduce said liquid into said cavity through said perforations in a plurality of independent streams.

2. An apparatus according to claim 1 wherein said streams converge to form a dome-like display.

3. An apparatus in accordance with claim 1, wherein said perforations are substantially circular in cross-section.

4. An apparatus in accordance with claim 3, wherein substantially all of said perforations are of substantially the same diameter.

5. An apparatus in accordance with claim 3, wherein a percentage of said perforations are of a first diameter and the remainder of said perforations are of a second diameter that is greater than said first diameter.

6. An apparatus in accordance with claim 5, wherein said percentage of said perforations comprises substantially one-half of said perforations.

7. An apparatus in accordance with claim 6, wherein said first diameter differs from said second diameter by no more than 1/32 inch.

8. An apparatus for delivering a liquid into a sink, said apparatus comprising a sink with a cavity having an inner wall and an outer wall and having a plurality of perforations extending therethrough, said perforations being distributed over a collar portion of said cavity, said apparatus further comprising a faucet assembly in fluid communication with said plurality of perforations and with a source of said liquid, said faucet assembly being selectively operable to introduce said liquid into said cavity through said perforations in a plurality of independent streams, said apparatus further comprising a distribution conduit positioned outside said cavity adjacent said outer wall and substantially surrounding said collar portion, said conduit being in fluid communication with said faucet assembly, a dispersion chamber juxtaposed between said conduit and said outer wall, said chamber being in fluid communication with said conduit, and a thickening element abutting said outer wall and juxtaposed between said chamber and said outer wall, said thickening element having a plurality of apertures extending therethrough, said plurality of apertures being in fluid communication with said chamber, and each one of said plurality of apertures being in fluid communication with one of said plurality of perforations.

9. An apparatus in accordance with claim 8, wherein said cavity is hemispherical in shape.

10. An apparatus in accordance with claim 9, wherein said perforations are substantially circular in cross-section.

11. An apparatus in accordance with claim 10, wherein substantially all of said perforations are of substantially the same diameter.

12. An apparatus in accordance with claim 10, wherein a percentage of said perforations are of a first diameter and the remainder of said perforations are of a second diameter that is greater than said first diameter.

13. An apparatus in accordance with claim 12, wherein said percentage of said perforations comprises substantially one-half of said perforations.

14. An apparatus in accordance with claim 13, wherein said first diameter differs from said second diameter by no more than 1/32 inch.

15. An apparatus in accordance with claim 8, wherein said faucet assembly is located remotely from said cavity.

16. In a liquid delivery system for a sink, said system comprising a sink with a cavity having an inner wall and an outer wall and a faucet assembly in fluid communication with a source of said liquid for selective introduction thereof into said cavity, the improvement comprising a plurality of perforations in said cavity, said perforations being distributed over a collar portion of said cavity, and a distribution conduit positioned outside said cavity adjacent said outer wall and substantially surrounding said collar portion, said conduit being in fluid communication with said faucet assembly, a dispersion chamber juxtaposed between said conduit and said outer wall, said chamber being in fluid communication with said conduit, and a thickening element abutting said outer wall and juxtaposed between said chamber and said outer wall, said thickening element having a plurality of apertures extending therethrough, said plurality of apertures being in fluid communication with said chamber, and each one of said plurality of apertures being in fluid communication with one of said plurality of perforations, said faucet assembly being adapted to selectively introduce said liquid into said cavity through said perforations in a plurality of independent streams.

17. An apparatus in accordance with claim 2, wherein said cavity is hemispherical in shape.

* * * * *